US005810183A

United States Patent [19]

Feider et al.

[11] Patent Number: 5,810,183

[45] Date of Patent: Sep. 22, 1998

[54] GANTRY CRANE WITH ELEVATING OPERATOR CAB

[75] Inventors: Thomas Feider; Norbert Lenius, both of Sturgeon Bay, Wis.

[73] Assignee: Marine Travelift, Inc., Sturgeon Bay, Wis.

[21] Appl. No.: 451,255

[22] Filed: May 26, 1995

[51] Int. Cl.[6] ..... B66C 19/00

[52] U.S. Cl. ..... 212/291; 414/460; 414/324; 414/344

[58] Field of Search ..... 212/290, 291, 212/324, 325, 326, 343, 344, 345, 288, 289; 187/305, 331, 335; 414/460, 459, 461; 254/324; 180/89.13, 326

[56] References Cited

U.S. PATENT DOCUMENTS

| | | | |
|---|---|---|---|
| 1,698,854 | 1/1929 | Nagao | 212/325 |
| 3,080,981 | 3/1963 | Kuschel et al. | 212/290 |
| 3,146,903 | 9/1964 | Bjorklund . | |
| 3,161,309 | 12/1964 | Baudhuin et al. . | |
| 3,241,686 | 3/1966 | Hurst . | |
| 3,251,496 | 5/1966 | Lamer et al. . | |
| 3,396,858 | 8/1968 | Baker et al. . | |
| 3,396,861 | 8/1968 | Houlton | 414/459 |
| 3,558,172 | 1/1971 | Lamer et al. . | |
| 3,675,786 | 7/1972 | Wilson . | |
| 3,759,409 | 9/1973 | Wenzel et al. . | |
| 3,888,356 | 6/1975 | Redelfs . | |
| 3,945,503 | 3/1976 | Cooper . | |
| 4,049,132 | 9/1977 | Strömbäck . | |
| 4,262,777 | 4/1981 | Christopher | 187/313 |
| 4,279,347 | 7/1981 | Appleman . | |
| 4,358,020 | 11/1982 | Thiele . | |
| 4,546,852 | 10/1985 | Martin et al. . | |
| 4,667,834 | 5/1987 | Lanigan et al. . | |
| 4,747,745 | 5/1988 | Pippen et al. . | |
| 4,749,328 | 6/1988 | Lanigan, Jr. et al. . | |
| 4,755,100 | 7/1988 | Schultz | 187/289 |
| 4,858,775 | 8/1989 | Crouch . | |
| 4,877,365 | 10/1989 | Lanigan, Jr. et al. . | |
| 5,529,452 | 6/1996 | Boyles et al. | 212/290 |

FOREIGN PATENT DOCUMENTS

| | | | |
|---|---|---|---|
| 685503 | 7/1930 | France | 2112 319 |
| 906990 | 3/1954 | Germany | 212/324 |
| 475936 | 5/1954 | Italy | 212/345 |
| 119553 | 10/1978 | Japan | 212/291 |
| 1047977 | 11/1966 | United Kingdom | 187/335 |
| 1236247 | 6/1971 | United Kingdom | 212/325 |

*Primary Examiner*—Thomas J. Brahan
*Attorney, Agent, or Firm*—Wallenstein & Wagner, Ltd.

[57] ABSTRACT

A gantry crane has first and second side support frames spaced by a pair of trolley beams. A lifting mechanism is connected to the trolley beams and includes a lift frame for engaging a load to be lifted. An operator cab is mounted on the first side support frame and is vertically moveable between a lowermost position and an uppermost position in an operational plane defined by the first side support frame. A cab lift cable has a length and a first end fixed to the operator cab and a second end fixed to the side support frame. A hydraulic cylinder urges the cable between its fixed first and second ends in a direction transverse to a portion of its length.

15 Claims, 6 Drawing Sheets

GANTRY CRANE WITH ELEVATING OPERATOR CAB

TECHNICAL FIELD

The present invention relates generally to a gantry crane, and more particularly to a gantry crane having an elevating operator cab.

BACKGROUND OF THE INVENTION

Gantry cranes have been used for many years for lifting and handling loads such as truck trailers, cargo containers, boats and the like. The cranes normally have a gantry structure that spans over the load(s). For example, in intermodal applications, it may span over two adjacent railroad cars or a truck trailer adjacent a railroad car. The gantry structure normally is comprised of a pair of side support frames, which are spaced by trolley beams. Each side support frame is generally comprised of two vertical legs connected at their bottom ends by a lower side beam and connected at their top ends by an upper side beam. Each side support frame defines a vertical plane.

Conventionally, a lift frame is suspended by flexible cables from the trolley beams. Spreaders, having a pair of descending arms, are located at or near each end of the lift frame. Each arm has a pivot shoe, or finger, that can engage a bottom side of a load, such as a truck trailer so that the load is engaged proximate its four corners. In some crane designs, the spreader arms can rotate to an inoperable position so that optional, specialized twist locks, can be provided on the spreader to engage a load, such as a cargo container, from the top of the container. Such a design allows intermodal operation of the gantry crane. In one mode, the crane moves loads using the spreader arms. In the other mode, the crane moves cargo containers using the twist locks.

Generally, an operator platform or an enclosed cab is provided on the gantry structure. From the platform or cab, an operator controls all of the movements of the gantry crane, i.e., the lift frame, spreader arms and the mobility of the gantry crane itself. Conventionally, the operator platform or cab is mounted either on the lower side beam of a side support frame or to one of the vertical legs.

One problem encountered by operators of gantry cranes is limited vision from the operator cab. With the operator cab in a fixed position, the operator's line of sight is also fixed. In intermodal operation, for example, the operator is unable to vary his line of sight regardless of the mode of operation or the type of load being lifted.

For instance, when a cargo container must be engaged at its top by the twist locks on the lift frame, it can be difficult for the operator, while sitting in the cab a few feet from ground-level, to properly align the twist lock with the top of the container. As a result, the operator requires more time to engage and move the container, therefore, lowering operation efficiency. In addition, the operator can damage the top of the container while attempting to properly align the twist locks with the container. Without seeing the top of the container, the operator must estimate the correct position of the twist locks and may accidently stab the container with the twist locks.

One proposed structure for allowing the operator to change his line of sight is disclosed in U.S. Pat. No. 4,877,365. Disclosed therein is a crane having a lift frame suspended from a gantry structure. The crane is provided with a first operator cab positioned near ground-level below a lower side beam of one side frame. The crane has a second operator cab positioned at an elevated position within the gantry structure. Thus, the operator can vary his line of sight by controlling the crane either from a position at ground-level or from an elevated position. This design is inconvenient, however, because the operator must leave one cab and then travel to the other cab to improve his view. Such a design also requires two sets of controls and associated wiring and instrumentation which increases costs. Finally, the design only gives the operator two vantage points, rather than allowing the operator to choose from a number of lines of sight.

The operator's limited vision from an operator cab positioned near ground-level can also cause problems when maneuvering the crane through a warehouse or railroad yard. With the cab near ground-level, it is difficult for the operator to steer the crane through stacks of containers or randomly-spaced truck trailers. As a result, the gantry crane can accidentally collide with these objects.

Thus, there is a need for a gantry crane having an operator cab that allows an operator to vary his line of sight to efficiently engage a load either from its bottom or from its top. The present invention is provided to solve these and other problems.

SUMMARY OF THE INVENTION

The present invention provides a gantry crane having a vertically moveable operator cab. According to one aspect of the invention, a gantry crane has first and second side support frames spaced by a trolley beam. A load lifting mechanism is connected to the trolley beam and has means for engaging a load to be lifted. An operator cab is mounted on the first side support frame. The operator cab is vertically moveable between a lowermost position and an uppermost position in an operational plane defined by the first side support frame.

According to another aspect of the invention, the first side support frame is comprised of two vertical legs connected by an upper side beam and a lower side beam. The lower side beam has a downwardly-extending portion to accommodate the lowermost position of the operator cab.

According to a further aspect of the invention, a mechanism is provided for vertically moving an operator cab on a gantry structure. A cable is provided having a length and a first end fixed to the operator cab. A second end of the cable is fixed to the gantry structure. Means are provided for urging the cable between its fixed first and second ends in a direction transverse to a portion of its length.

According to yet another aspect of the invention, means are provided for preventing an access door of the operator cab from fully opening when the operator cab is raised from its lowermost position. Means are provided for preventing the spreader from being operated while the cab is being raised on the gantry crane. Means are provided for preventing the operator cab from being lowered too quickly. Means are also provided for preventing vertical movement of the operator cab when the access door is open.

According to another aspect of the invention, an operator cab is provided having opposing side walls connected by a front wall and a side wall.

Other advantages and aspects of the present invention will become apparent upon reading the following description of the drawings and detailed description of the invention.

DETAILED DESCRIPTION OF THE INVENTION

Figure 1:
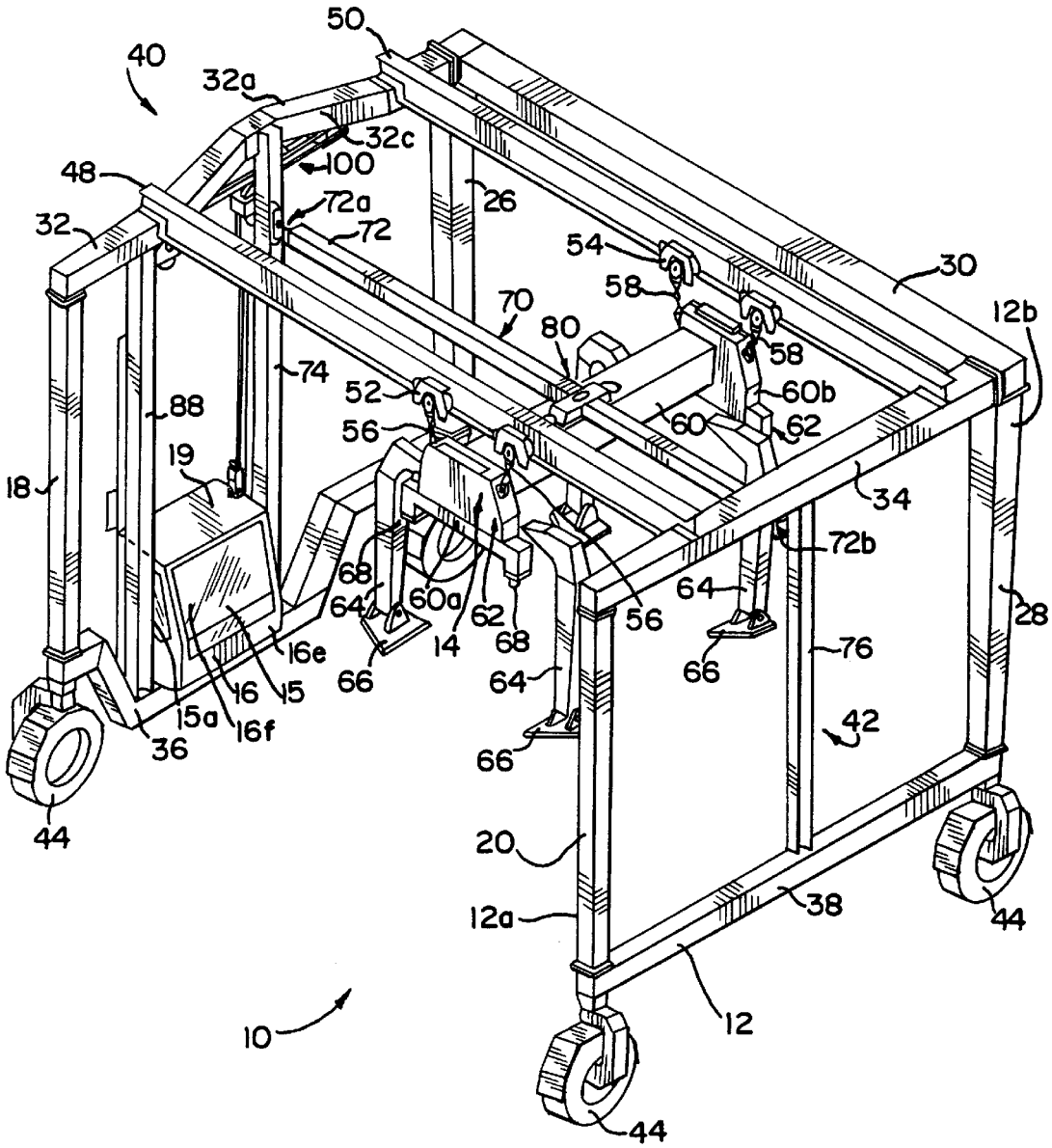
FIG. 1 is a perspective view of the gantry crane of the present invention with an operator cab on a first side support frame of the gantry crane.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiments illustrated.

FIGS. 1–7 disclose a gantry crane 10 having a vertically moveable operator cab 16 constructed in accordance with the principles of the present invention. FIG. 8 discloses a hydraulic schematic diagram for a lifting mechanism 100 for the operator cab 16. The structure of the gantry crane 10 and operation of the operator cab 16 will be described and then the structure and instrument and control layout of the operator cab 16 will be described in greater detail.

Gantry Crane Structure

As disclosed in FIG. 1, the gantry crane 10 generally includes a gantry structure 12, a load lifting mechanism 14 and an operator cab 16. The load lifting mechanism 14 is connected to the gantry structure and includes apparatus for lifting a load. The operator cab 16 is mounted on the gantry structure 12. As best disclosed in FIG. 2, the operator cab 16 is vertically moveable on the gantry structure 12. A lowermost position of the cab 16 is shown in solid lines at A, and an upper position of the operator cab 16 is shown in phantom lines at B.

The gantry structure 12 has four vertical legs 18, 20, 26 and 28. Legs 18 and 26 are connected near their bottom ends by a lower side beam 36 and are connected at their top ends by an upper side beam 32. Legs 20 and 28 are similarly connected near their bottoms ends by a lower side beam 38 and connected at their top ends by an upper side beam 34.

Legs 18 and 26 and the connecting upper and lower side beams 32 and 36, respectively, define a first side support frame 40. Legs 20 and 28, and the connecting upper and lower side beams 34 and 38, respectively, define a second side support frame 42. The first side support frame 40 defines an operational plane where the operator cab 16 is positioned to operate. In other words, the cab 16 intersects all possible vertical plans through legs 18 and 26 of the first side support frame 40.

The side support frames 40 and 42 are interconnected by trolley beams 48 and 50 which are spaced from each other. The trolley beams 48 and 50 are preferably I-beams and are mounted on a upper side of the top side beams 32 and 34. As further disclosed in FIG. 1, a top beam 30, spanning between the side support frames 40 and 42, is provided at a front end 12*b* of the gantry structure 12. The primary function of top beam 30 is to provide structural integrity to the gantry structure 12. It also provides a mounting bridge for routing hydraulic and electrical circuitry between the side support frames 40 and 42.

The gantry structure 12, thus formed, is an open-ended box-like structure sufficient to span over adjacent loads, such as two railcars or a railcar adjacent a truck trailer. The benefits of the present invention, however, can be realized with other gantry structures. For instance, a two-legged gantry structure utilizing only one trolley beam and trolley could also be used.

The gantry structure 12 is also equipped with four (4) wheels 44. One wheel 44 is located at a bottom end of each of the vertical legs 18, 20, 26 and 28. The wheels 44 are powered by hydraulic motors (not shown) to make the gantry crane 10 self-mobile. The wheels 44 could also be railroad wheels that ride on railroad tracks. The gantry structure 12 could also be equipped with link-belt type tracks as used on many boom-type cranes.

Figure 2:
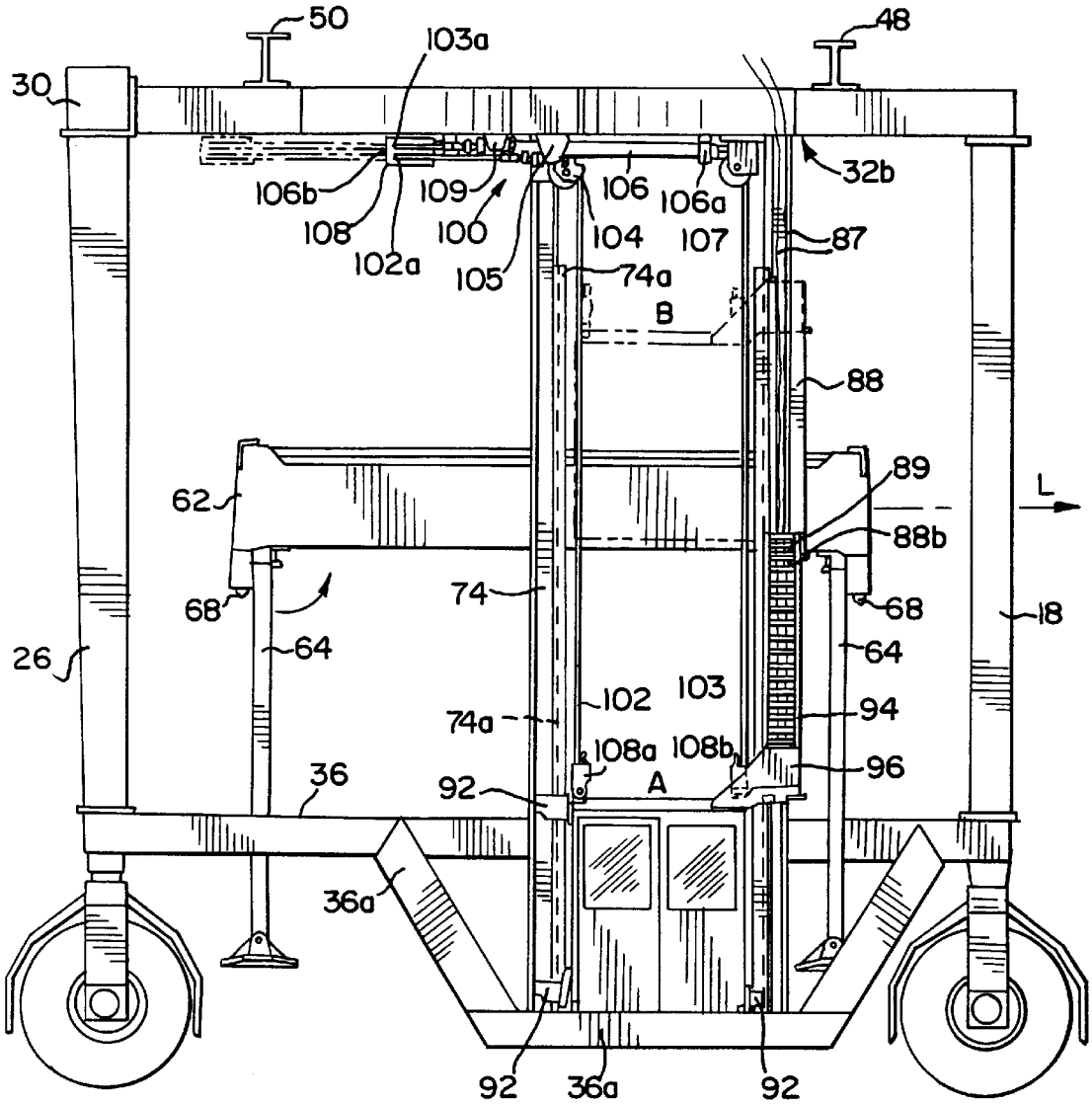
FIG. 2 is a side view of the gantry crane of FIG. 1 disclosing the operator cab accommodated by a downwardly-extending portion of a lower side beam of the first side support frame, the operator cab being at a lowermost position with an upper position shown in phantom lines.

As best disclosed in FIGS. 1 and 2, the load lifting mechanism 14 is comprised of a conventional apparatus including first and second trolleys 52, 54, first and second lift cables 56, 58 and a lift frame 60. The first trolley 52 rides on trolley beam 48 positioned towards a rear end 12*a* of the gantry structure 12. The second trolley 54 rides on trolley beam 50 positioned towards the front end 12*b* of the gantry structure 12. A rear end 60*a* of the lift frame 60 is suspended from the first trolley 52 by a first lift cable 56. A front end 60*b* of the lift frame 60 is suspended from the second trolley 54 by a second lift cable 58. The lift cables 56 and 58 extend from the trolleys to winches (not shown) that are mounted on the gantry structure 12. The winches raise and lower the lift frame 60 via the lift cables 56 and 58 toward and away from the first and second trolleys 52 and 54. As the trolleys 52 and 54 move laterally on the trolley beams 48 and 50, the lift frame 60 is moved laterally within the gantry structure 12.

As best disclosed in FIGS. 1 and 2, the lift frame 60 is equipped with a pair of spreaders 62. The spreaders 62 have arms 64 that depend from the lift frame 60. Each arm 64 has a pivot shoe 66, that can engage the bottom side of a load, such as a truck trailer. When it is desired or necessary to engage a load at its top, the arms 64 can rotate out of the way (in the direction of the arrow in FIG. 2) and the load can be engaged by specialized twist locks 68 located on the lift frame 60. The spreaders 62 on the lift frame 60 can extend longitudinally within the gantry structure 12 to adjust to various load lengths. The lift frame 14 also houses various control mechanisms for the spreaders 62, as is conventional.

The gantry crane 10 is also equipped with stabilizing apparatus 70 to prevent unwanted sway of the lift frame 60 within the gantry structure 12. The stabilizing apparatus generally includes a horizontal stabilizing beam 72 with vertical guides 74,76 to prevent longitudinal and lateral sway, i.e., pendulous motion of the lift frame 60. A reeving arrangement (not shown), attached between the trolleys 52,54 and the lift frame 60, is used to dampen rotational sway, i.e., twisting of the ends 60*a*,60*b* of the lift frame 60. As best disclosed in FIG. 1, the stabilizing beam 72 operatively connects the lift frame 60 to the gantry structure 12. The lift frame 60, is pivotally connected to the stabilizing beam by a gimbal 80. Ends 72*a*,72*b* of the stabilizing beam 72 are connected to the vertical guides 74,76 that are connected to the side support frames 40,42 respectively. In a preferred embodiment, the vertical guides 74,76 are vertical guide tracks, e.g., I-beams, that extend between the upper side beams 32,34 and lower side beams 36,38 of each side support frame 40,42. The stabilizing beam 72 is vertically moveable along the vertical guide tracks 74,76 as the lift frame 60 is raised and lowered. With the stabilizing beam 72 connected to the lift frame 60 and vertical guide tracks 74,76, longitudinal and lateral sway of the lift frame 60 is prevented.

Operator Cab On Gantry Structure

Figure 3:
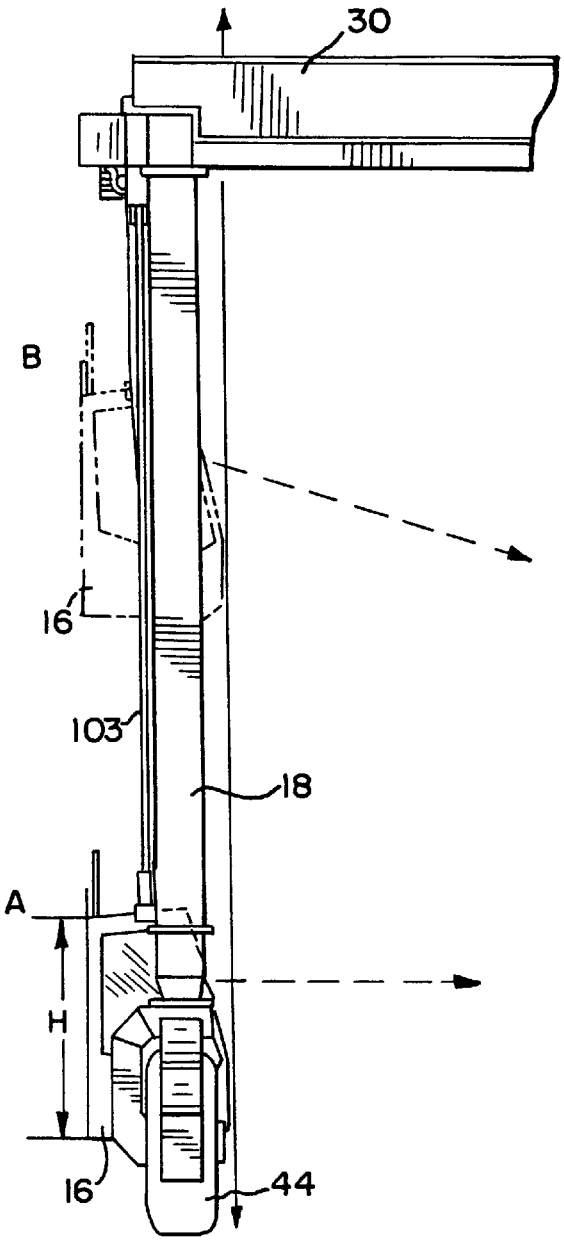
FIG. 3 is a partial rear view of the gantry crane of FIG. 1 disclosing the operator cab intersecting an operational plane defined by the first side support frame, the operator cab being in a lowermost position; an upper position is shown in phantom lines.

As best disclosed in FIGS. 2 and 3, the operator cab 16 is vertically moveable in the operational plane defined by the first side support frame 40. The operational plane extends between the vertical legs 18,26. The cab is lifted by a lifting mechanism 100 to be described below. The cab 16 can thus, traverse in a vertical path between a lowermost position, designated at A, and an uppermost position, designated at B (shown in phantom lines). The uppermost position B could vary depending on the design of the crane. The larger the gantry crane 10, the higher the operator cab 16 can move vertically. In the present invention, the uppermost position of the operator cab is approximately 21 feet. In addition, the operator cab 16 can be stopped at any position between the lowermost position A and the uppermost position B providing completely variable vertical lines of sight to the operator when operating the gantry crane 10.

A vertically moveable operator cab is especially desirable with intermodal operation where the gantry crane 10 is lifting loads using the spreader arms 64, such as truck trailers, or lifting loads using the specialized twist locks 68, such as cargo containers. For example, when lifting a truck trailer, the spreader arms 64 engage the trailer at its bottom. When an operator attempts to engage the spreader arms under a trailer, his view is best when looking directly across at the bottom the trailer and spreader arms. Thus, an optimum line of sight may be obtained by positioning the operator cab 16 near groundlevel, as represented by the solid lines in FIG. 3. Conversely, when lifting a cargo container, the specialized twist locks 68 engage the container at its top. When the operator aligns the twist locks 68 with the container, his view is best when positioned at an elevated position looking over the container top. Thus, by vertically moving the operator cab 16 to a position such as B, the operator may obtain a direct view of an upper portion of the container and lift frame 60, as represented by the dotted line in FIG. 3. The vertical position of the operator cab 16 can be readily changed depending on the type and size of the load being lifted.

In order to add stability to the vertically moveable operator cab 16, the cab 16 is moveable along first and second spaced vertical guides 74,88 connected to the first side support frame 40. In its preferred form, the guides 74,88 are vertical guide tracks, or I-beams. Also, the first vertical guide track 74 functions as both the guide track for the stabilizing beam 72 and the operator cab 16. As best disclosed in FIGS. 2 and 5, an additional flange 74*a* is attached to the first vertical guide track 74 for cooperation with the operator cab 16. Likewise, a flange 88*a* is attached to the second vertical guide track 88 for cooperation with the operator cab 16. However, separate vertical guide tracks could be used for the stabilizing beam 72 and operator cab 16, if desired. Using the guide track 74 for both the stabilizing beam 72 and operator cab 16 saves material and reduces the weight of the gantry crane 10. Further, a single guide track 74 on either side of the cab 16 could be used to guide the operator cab 16. Two guide tracks are preferred, however, to add stability to the operator cab 16 when being moved vertically.

Still referring to FIG. 2, the first and second guide tracks 74,88 extend between the lower side beam 36 and upper side beam 32 and in the operational plane defined by the first side support frame 40. The operator cab 16 is positioned between the guide tracks 74,88 and has a pair of slotted brackets 92 on opposing sides of the operator cab 16. As best disclosed in FIGS. 5 or 7, the slotted brackets 92 define a slot 93 which engages around the guide tracks 74,88. Specifically and as best disclosed in FIG. 7, the assemblies 92 have tab portions 92*a* that fit on either side of the flange 74*a* of the first guide track 74 and flange 88*a* of the second guide track 88. The slotted brackets 92 prevent the operator cab from swaying out of the operational plane during vertical movement. Shims 92*b* can be added to the slotted brackets 92 for a close-fit with the guide tracks 74,88, and are preferably made of resilient low-friction materials, such as polypropylene plastic.

The side support frame 40 has a number of features to enhance the lines of sight obtainable to an operator in the operator cab 16 and the operator's ability to operate the gantry crane more efficiently. As best disclosed in FIGS. 1 and 2, the lower side beam 36 of the first side support frame 40 has a downwardly-extending portion 36*a* that accommodates the operator cab in its lowermost position. The first and second vertical guide tracks 74,88 are connected to the first side support frame 40 within the confines of downwardly-extending portion 36*a*. With conventional designs, the lower side beam 36 extends directly horizontally from the front leg 26 straight across to the rear leg 18 several feet from the ground. The lowermost position of the operator cab 16 would be defined by the straight lower side beam causing the operator cab 16 to rest too far above ground-level. Such a design makes it impossible for the operator to have a line of sight directly across at a bottom of a truck trailer a few feet from ground-level. The downwardly-extending portion 36*a* of the first side support frame 40 accommodates the operator cab 16 at a position which allows the vertically-moveable operator cab 16 to be positioned close to ground-level. This improves an operator's view when engaging a load at its bottom.

Figure 4:
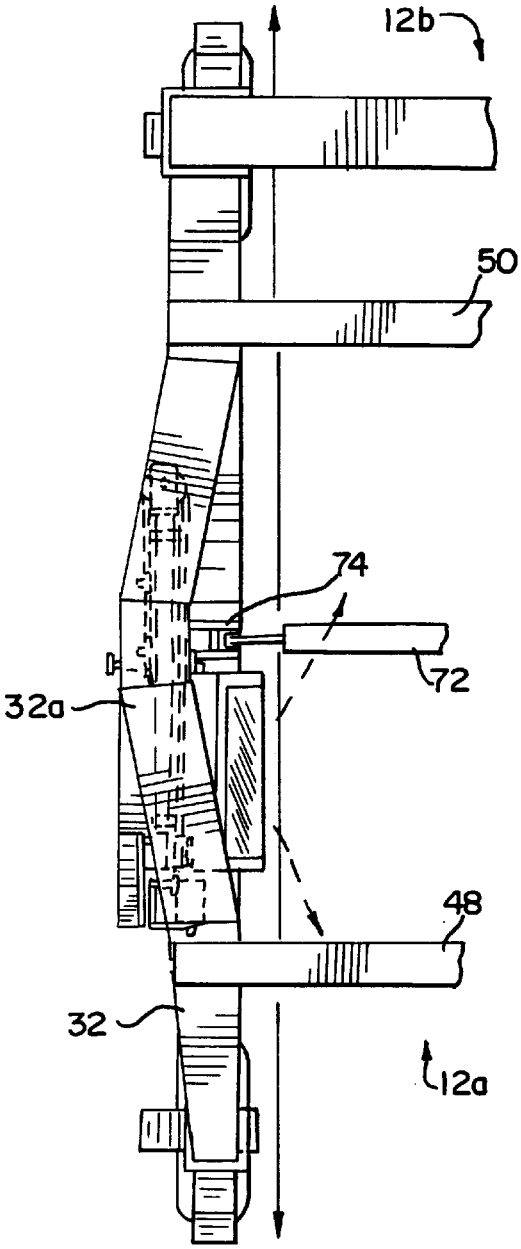
FIG. 4 is a partial plan view of the crane of FIG. 1 disclosing an upper side beam of the first side support frame having an offset portion.

Another feature that improves the operator's vision is best disclosed in FIGS. 1 and 4. The upper side beam 32 of the first side support frame 40 has offset portion 32*a*, i.e., the side beam extends outwardly from the gantry structure 12. This feature allows the vertical guide tracks 74, to be attached to the offset portion 32*a* at an inner side 32*c* of the upper side beam 32 to accommodate the stabilizing beam 72 when the lift frame 60 is at its uppermost position while maintaining the operator cab 16 in the operational plane defined by the first side support frame 40. As explained below, this allows the guide track 74 to continue to be set back away from the of the operator cab 16. With this configuration and as best shown in FIG. 4, the tracks 74,88 are not in the operator's line of vision looking towards the rear end 12*a* and front end 12*b* of the gantry structure 12.

As previously noted, the first and second guide tracks 74,88 extend between the lower side beam 36 and upper side beam 32 of the first side support frame 40. The second vertical guide track 88 is connected at a bottom side 32*b* of the upper side beam 32. The first guide track 74, however, must extend beyond the upper side beam 32 to accommodate the stabilizing beam 72 when the lift frame 60 is at its highest position. Therefore, the first guide track 74 must be mounted on an inner side 32*c* of the upper side beam 32 as disclosed in FIG. 1. However, the operator cab 16 also is guided by the first guide track 74. If this connection was to an inner side of a straight upper side beam having no offset portion, the resulting position of the first guide track 74 would be towards the front of the operator cab 16. The first guide track 74 would then obstruct the operator's view towards the front end 12*b* of the gantry structure 12. Alternatively, such a position of the first guide track 74 would also cause the operator cab 16 to extend further within the gantry structure 12 and beyond the operational plane defined by the first side support frame 12. The operator cab would extend inwardly across an inner clearance line of the gantry structure, the inner clearance line being shown in FIGS. 3 and 4. This is undesirable because it is important to maximize the space within the gantry structure 12 to provide enough clearance between the load and side support frames.

With the present design, the first guide track 74 is accommodated on the inner side 32*c* of the upper side beam 32, while the offset portion 32*a* of the upper side beam 32 allows the first guide track 74 to be set back with respect to the operator cab 16. Thus, the operator cab 16 is within the operational plane defined by the first side support frame 40 and the first guide track 74 does not obstruct the operator's view towards the front end 12*b* of the gantry structure 12, as shown by the dotted line in FIG. 4, because the guide track 74 is attached to the inner side 32*c* of the upper side beam 32 at the offset portion 32*a*.

The operator can control all of the movements of the gantry crane from the operator cab 16. The cab 16 is provided with controls for a hydraulic steering system that controls the wheels 44, the load lifting mechanism 14 and the lifting mechanism 100 for the operator cab 16 and the operation of the cab 16 itself. Accordingly, control lines 87 extend from different sections of the crane 10 to the operator cab 16. As best disclosed in FIGS. 1 and 2, these lines come together proximate the upper side beam 32 of the first side support frame 40. The lines then advance downwardly along the second vertical track 88 and enter a junction cluster 89 at an intermediate location 88*b* on the second guide track 88. The lines then extend back upwardly from junction cluster 89 to a flexible link conduit 94. The flexible link conduit 94 forms an upwardly extending loop from the intermediate location 88*b* and the operator cab 16. The flexible link conduit 94 is sectioned to separate the control lines 87 side-by-side. The link conduit 94 is anchored to a conduit bracket 96, which is affixed to the top of cab 16. The control lines 87 extend from the end of the link conduit 94 to points on the cab 16 sidewall. The control cables then are ported through the sidewall and are connected to the various controls and gauges inside the operator cab. As the operator cab is elevated, the link conduit 94 carries the lines 87 upwardly as the curled loop portion of the link track moves vertically along the second guide track. The link track thus keeps the lines from getting tangled and possibly getting caught in the slotted brackets 92 of the operator cab 16.

As previously noted, the operator cab 16 is vertically moveable by the lifting mechanism 100 in the operational plane defined by the first side support frame 40. As best disclosed in FIG. 2, the operator cab 16 is lifted by a pair of lift cables 102 and 103. Each lift cable 102,103 has a length and has a first end fixed to the operator cab 16. The lift cable 102 has a second end fixed to the first side support frame 40 at bracket 105. The lift cable 103 has a second end fixed to the first side support frame 40 at bracket 109. A hydraulic cylinder 106 is provided to urge the lift cable 102 between its fixed first and second ends in a direction transverse to a portion of its length.

A first pulley 104 is mounted on the upper side beam 32 of the first side support frame 40 proximate the first guide track 74. A second pulley 107 is mounted on the upper side beam 32 of the first side support frame 40 proximate the second guide track 88.

The hydraulic cylinder 106 has one end 106*a* mounted on a bottom side 32*b* of the upper side beam 32 of the first side support frame 106. The hydraulic cylinder 40 has an opposed end 106*b* adapted to contact the cab lift cables 102,103. It will be appreciated that the cylinder 106 could also be fixed to the upper side beam at additional locations for added stability. The cylinder 106 has an extension path which is transverse to a portion 102*a*,103*a* of the length of lift cables 102,103. In its preferred embodiment, the opposed end has a double-sheeve pulley 108 mounted thereon. Transverse direction means any direction or angle other than along the length of the portion of the cable, in other words, any direction tending to move the cable out of its path.

The cab lift cables 102, 103 follow similar paths. Lift cable 102 has one end fixed to a first bracket 108*a* on the operator cab 16. The lift cable 102 extends upwardly and around the pulley 104. The cable 102 proceeds around the double-sheeve pulley 108 and is fixed to the upper side beam 32 at bracket 105. The lift cable 103 has one end fixed to second bracket 108*b* on the operator cab 16. The lift cable 103 extends upwardly and around the pulley 107. The cable 103 advances around the double-sheeve pulley 108 and is fixed to the upper side beam 32 at bracket 109.

The extension path of the cylinder 106 is such that the opposed end 106*b* of the cylinder 106 urges the cables 102,103 in a portion 102*a* and 103*a* of its length lying between the pulleys 104,107 and the second ends fixed at the brackets 105,109. Thus, as the cables 102,103 are urged in a direction transverse to their lengths by the cylinder 106 (shown in phantom lines in FIG. 2), the operator cab 16 is vertically moved from the lowermost position A to an upper position B. The hydraulic cylinder 106 can be controlled to position the operator cab 16 anywhere along the guide tracks 74,88 between its lowermost and uppermost positions. As best disclosed in FIG. 8, the hydraulic cylinder 106 has fluid connections at both ends of the cylinder 106 to better control the extension of the cylinder and vertical movement of the operator cab 16. Thus, the vertically moveable operator cab allows the operator to vary his lines of sight (dotted lines in FIG. 3) to improve his vision from the operator cab 16.

There are also other means contemplated for vertically moving the operator cab 16. For example, a single lift cable attached nearer the center of cab 16 could be used. Also, a winch could be mounted on the gantry structure with a cable having opposing ends fixed to the winch and gantry structure. The winch, with appropriate cable guides and pulleys, could be positioned in any of a number of locations on the gantry structure as well. The cable is accumulated by the winch, thus, vertically moving the operator cab 16.

A driven gear mechanism cooperatively engaging the operator cab and guide tracks 74,88 could also be used. For example, drive gears could be mounted on the operator cab to mesh with a toothed-guide track. Similarly, a chain and sprocket arrangement could also be utilized. A hydraulic lift cylinder could be mounted to either a bottom of the operator cab 16 or to the top of the cab 16 to vertically move the cab by extension of the cylinder. Also, a counterweight system could be used.

Figure 5:
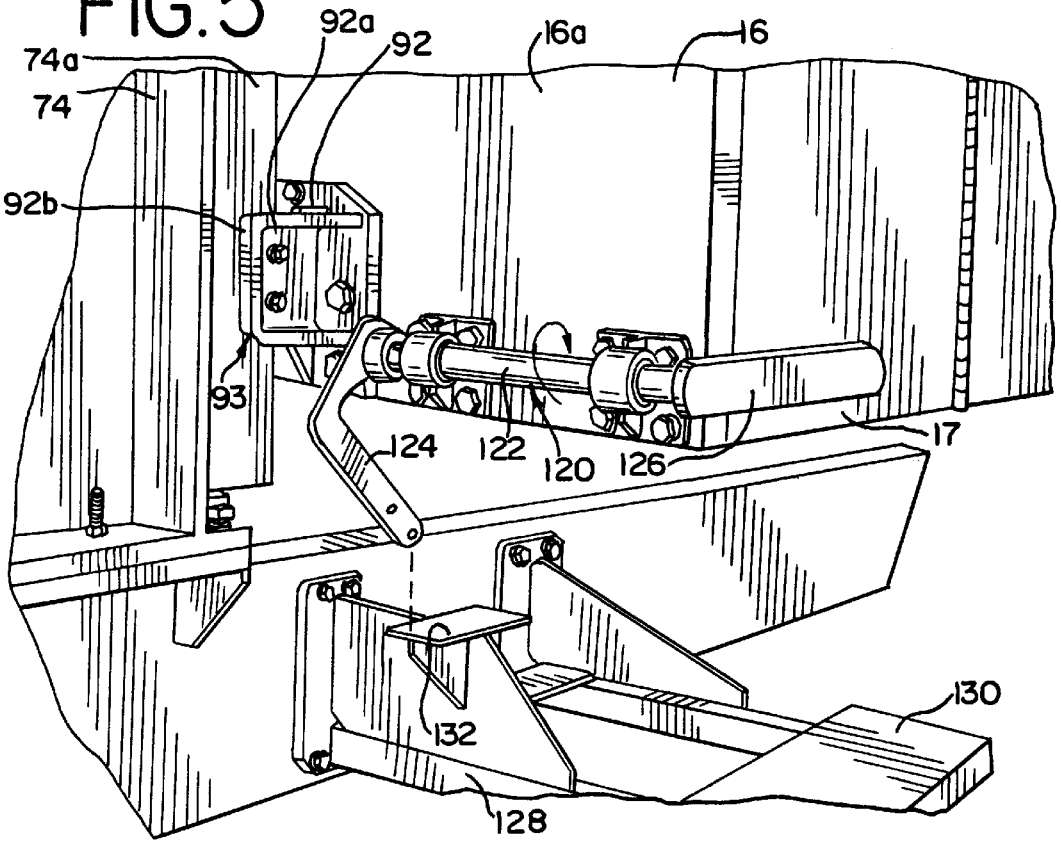
FIG. 5 discloses an enlarged perspective view of the crane of FIG. 1 disclosing a mechanical safety device in a closed position.
Figure 6:
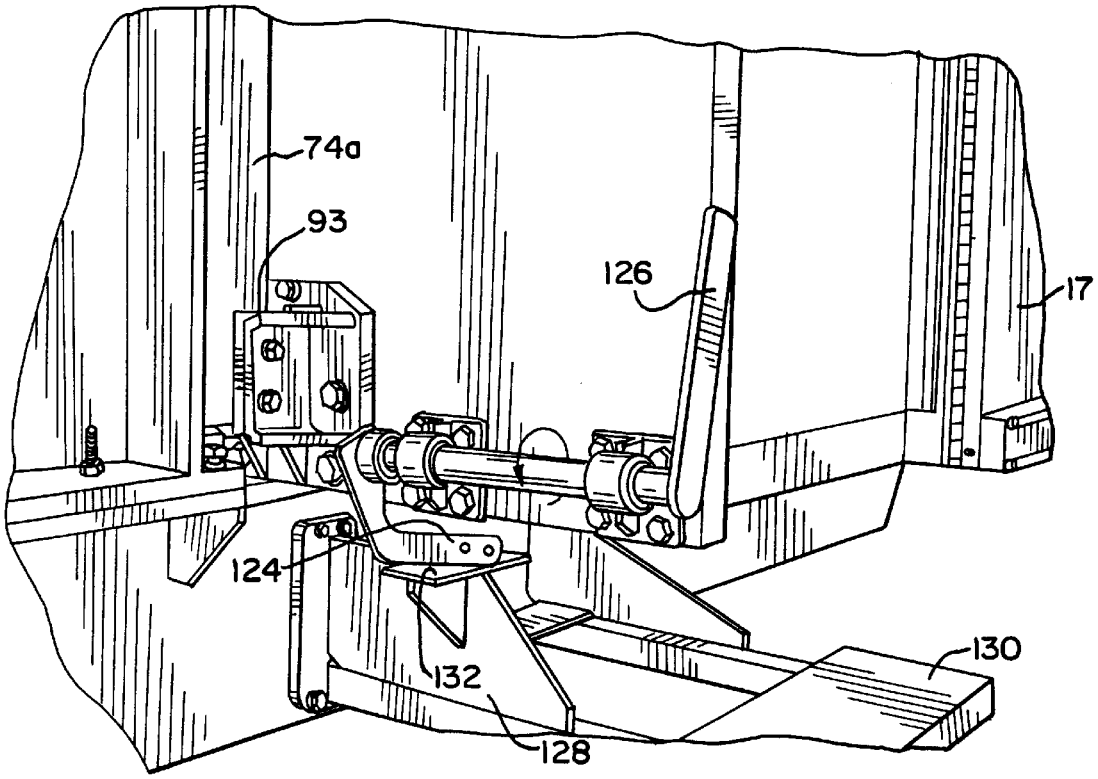
FIG. 6 discloses an enlarged perspective view of the mechanical safety device of FIG. 5 disclosing an open position.

It is important to provide safety measures to prevent an operator from accidentally falling out of the operator cab 16 when vertically moved to an elevated position. As best disclosed in FIGS. 5 and 6, a mechanical safety device 120 is provided to prevent an access door 17 of the operator cab 16 from fully opening when the operator cab 16 is raised from its lower-most position. The device 120 generally includes a shaft 122 having a first arm 124 and a second arm 126 mounted thereon. The shaft 122 is rotatably mounted to an outside portion of the operator cab 16, for example, to a side wall 16*a* adjacent the access door 17. A step bracket 128 is mounted to the lower side beam and has a step 130 connected thereon to assist an operator getting into the cab 16. A platform 132 is mounted on the step bracket underneath the operator cab 16. When the operator cab 16 is in its lower-most position as shown in FIG. 6, the first arm 124 contacts the platform 132, maintaining the position of the shaft 120. In this position, the second arm 126 is positioned vertically beside the operator cab 16. As the operator cab is vertically moved from its lower-most position as shown in FIG. 5, the first arm 124 loses contact with the platform 132. The first arm 124 acts as a counterweight rotating the shaft 120 in the direction of the arrow in FIG. 5. As the shaft 120 rotates, the second arm 126 moves across a portion of the access door 17. A stop (not shown) is provided on the shaft 120 to maintain the second arm 126 horizontally across the access door 17. Thus, when the operator cab 16 is elevated as in FIG. 5, the second arm 126 prevents the access door 17 from fully opening.

FIG. 8 discloses schematically the hydraulic circuit for controlling the cylinder 106 of lifting mechanism 100. Generally, hydraulic fluid is supplied from a 16 gallon per minute pump 140 through associated valving to the hydraulic cylinder. Fluid return lines are also provided. The circuit has certain safety features that protect the operator and the gantry crane 10. For instance, the cylinder 106 cannot elevate the operator cab 16 at the same time as operating the spreader 62 functions of the load lifting mechanism 14, such as the moving the spreader 62 arms and vice versa. The functions of spreader 62, however can be operated when the cab is being lowered. The operator can advance the vertical position of the operator cab 16 and then operate the spreader 62. If desired, in alternate embodiments, the entire operation of the load lifting mechanism 100 could be prevented when operating the lifting mechanism 14. A control/switching valve 142 is provided that directs hydraulic fluid to either the spreader 62 or the cylinder 106 mechanism. Thus, when raising the cab 16, hydraulic fluid cannot reach the load lifting mechanism 14 to operate the spreaders 62. Hydraulic fluid cannot reach both mechanisms at the same time to operate them simultaneously. Also a flow control valve 144 and velocity fuse valve 146 are provided in series between the control/switching valve 142 and the hydraulic cylinder 106. When the operator wishes to lower the operator cab 16 from an elevated position, the hydraulic fluid must be relieved from the cylinder 106. The flow control valve 144 is manually set to control the rate of fluid being relieved from the cylinder. Preferably, the valve 144 regulates flow at 16 GPM to correspond to the pump capacity. This assures the operator cab is lowered smoothly and at a controlled rate identical to the rate at which the cab 16 is raised.

If the flow control valve 144 malfunctioned, hydraulic fluid could be relieved at a rate much greater than 16 GPM. This could possibly allow the operator cab to free-fall less any friction between the operator cab guide brackets 92 and the guide tracks 74,88. The velocity fuse valve 146 is provided to prevent such a scenario. The velocity fuse valve 146 senses the rate at which fluid is relieved from the cylinder. The valve 146 is set to close once the rate exceeds a nominal closing flow. For cab 16, the set point is 25 GPM. If the velocity fuse valve 146 senses more than 25 GPM, it will close. The remaining hydraulic fluid is then trapped in the cylinder. Consequently, the operator cab is stopped. Preferably, the velocity fuse valve 146 is positioned in closed proximity to the hydraulic cylinder to minimize response time. Both the flow control valve 144 and velocity fuse valve 146 are available from Vonberg Valve, Inc.

Also, it is possible though unlikely, for a system malfunction to maintain the operator cab 16 at an elevated position. Without hydraulic control, the operator cab 16 would be stranded at the elevated position. Therefore, the hydraulic circuit is provided with a manual flow control valve 148 as shown in FIG. 8. This valve is located inside the operator cab 16 (not shown) so that an operator could manually relieve the hydraulic pressure in the cylinder 106 and lower the operator cab 16. Thus, if a control malfunction stranded the operator cab at an elevated position, the operator can still lower the cab to its lowermost position. Also, a flow switch 149 is provided in the hydraulic circuit. As hydraulic fluid is relieved from the cylinder 106, the flow switch 149 activates an alarm (not shown) to alert bystanders that the cab 16 is being lowered.

Finally, there is provided another safety feature that prevents the operator cab 16 from being vertically moved when the access door 17 on the cab 16 is not closed. As best disclosed in FIG. 7, a closed door limit switch 152 is provided on the access door operator cab 16 at the access door 17. The closed door limit switch must be made up, i.e., the access door 17 of the operator cab 17 must be closed before the cab 16 can be vertically moved.

Another feature is use of the Digitrac valves for enhancing the control of vertical movement of the operator cab 16. These valves are spooled by servo-motors. The vertical movement of the cab 16 is controlled through software, in digital steps. The Digitrac valves dampen the response of the hydraulic system so that the operator cab 16 starts and stops smoothly.

Operator Cab Structure

Figure 7:
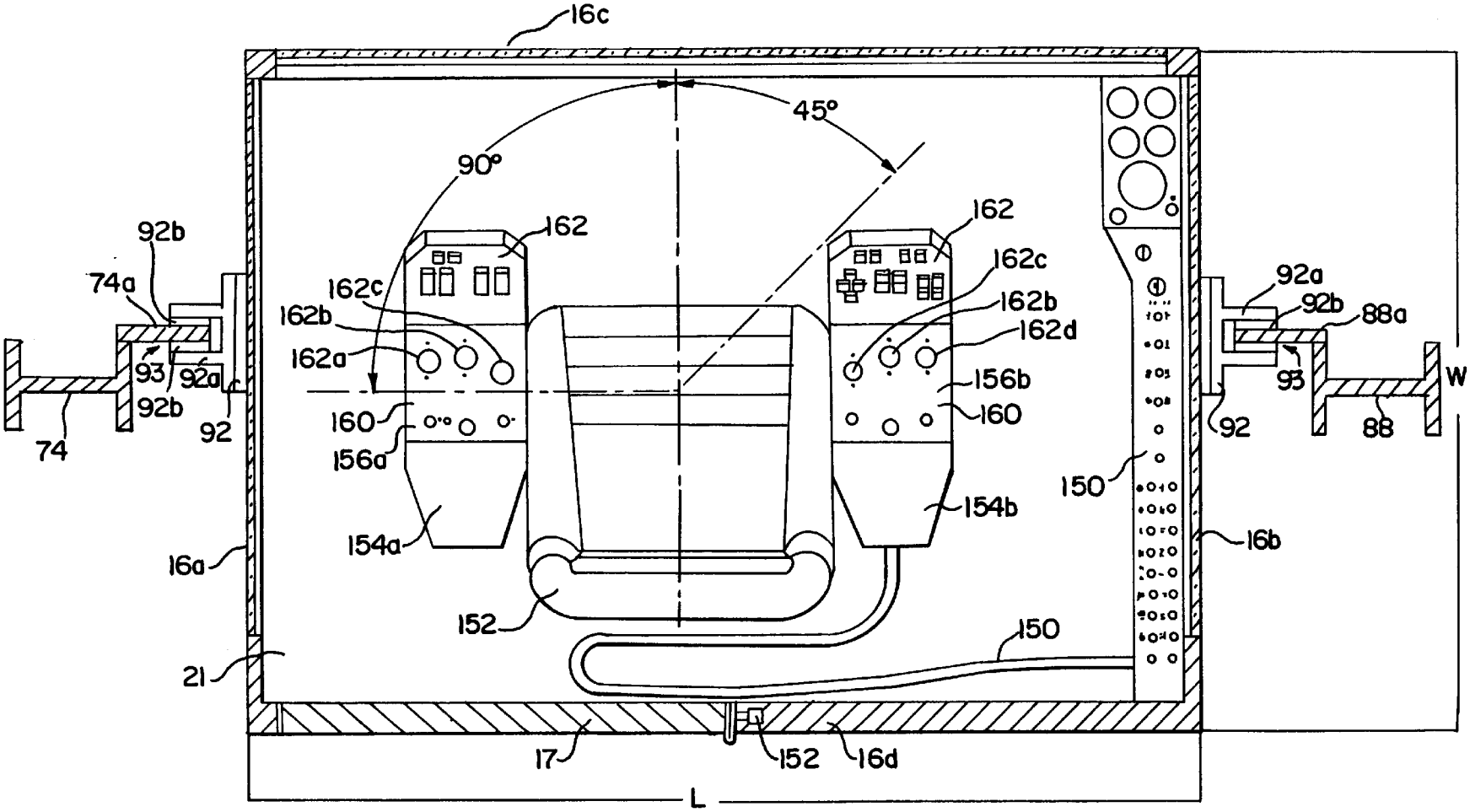
FIG. 7 is a cross-sectional plan view of the interior of the operator cab; and, FIG. 8 is a hydraulic circuit schematic for a lifting mechanism of the operator cab of the crane of FIG. 1.
Figure 8:
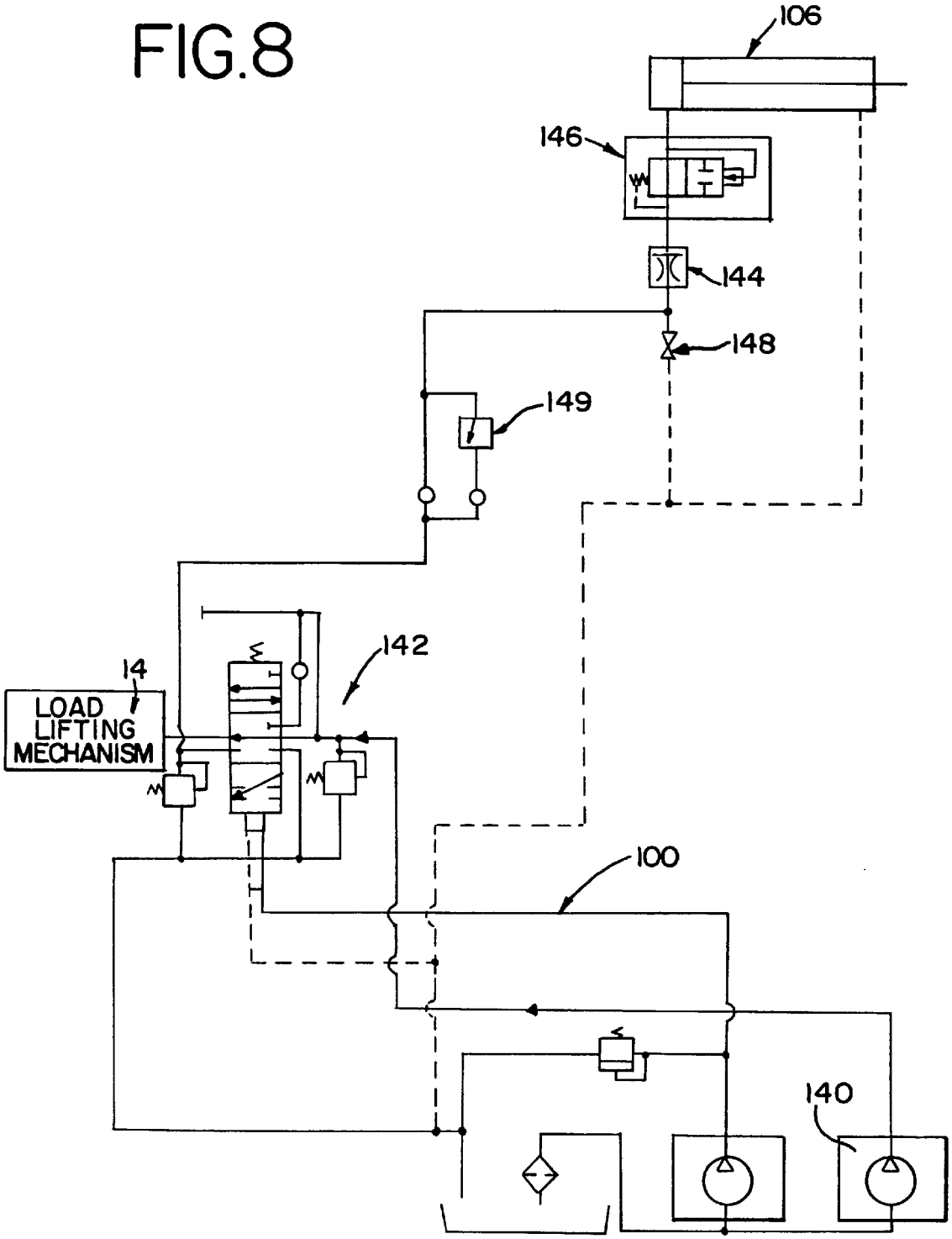

FIGS. 1, 2 and 7 best disclose the exterior and interior structure of the operator cab 16. The operator cab 16 has a pair of side walls 16*a*,16*b* connected by a front wall 16*c* and rear wall 16*d*. The walls are enclosed by a top 19 and a bottom 21, thus forming a box-like structure defining a height H, a length L and a width W of the cab 16. The access door 17 of the cab is provided on the rear wall 16*d*. The door 17 opens outwardly from the gantry structure 12. The front wall 16*c* has a lower upright portion 16*e*, and an upper inclined portion 16*f*.

Each wall 16*a*–*d* has a window across substantially the entire wall. This maximizes the operator's view in all directions. In addition, the window 15 on the front wall 16*c* extends from the upper inclined portion 16*f* down into the lower upright portion 16*e*. When the operator is seated inside the operator cab 16 at an elevated position, the operator can see downwardly because the window extends into the lower upright portion 16*e*.

FIG. 7 discloses a plan view of the interior layout of the operator cab 16. Located against the side wall 16*b* is an instrument panel 150 for displaying control pressures and housing ignition switches and the like. The instrument panel 150 is contoured to follow a side window 15*a* lower edge.

An operator seat 152 is centrally mounted to the bottom 21 of the operator cab 16 and faces the front wall 16*c*. The seat 152 is equipped with arm rests 154*a*,154*b* on each side of the seat 152. Positioned slightly below and confronting each arm rest is a control pod 156*a*,156*b*. The control pods 156*a*,156*b* are manipulated by the operator to control the movements of the crane such as movement of the trolleys 52,54, lift cables 56,58, spreader arms 64, operator cab 16, or mobility of the gantry crane 10 itself. The control pods 156*a*,156*b* are adjustable on the seat to different heights from the bottom 21 of the operator cab 16.

Also, the seat is rotatable at least 45 degrees towards the instrument panel 150 and at least 90 degrees towards the opposite side wall 16*a*. The control lines 158 that feed into the operator cab 16 and control pods 156*a*,156*b* from the different locations on the gantry crane 10 rotate with the seat.

The control pod 156*a*,156*b* has a planar section 160 adjacent an inclined section 162. The planar section 160 contains three joysticks 162*a–c* that control various movements of the crane. The inclined section 162 houses various indicating lights and other control switches. The planar section 160 of the control pod 156*a*,156*b* confronts the arm rests 154*a*,154*b* on the operator seat 152 and is slightly lower than the arm rests 154*a*,154*b*. In such a configuration where the operator's arms are resting on the arm rests 154*a*,154*b*, the operator's hands extend easily to the control pods 156*a*,156*b*.

While the specific embodiments have been illustrated and described, numerous modifications come to mind without significantly departing from the spirit of the invention and the scope of protection is only limited by the scope of the accompanying Claims.

We claim:

1. A gantry crane comprising:

a first side support frame having two vertical legs connected by an upper side beam and a lower side beam;

a second side support frame having two vertical legs connected by an upper side beam and a lower side beam;

a beam spacing the first and second side support frames;

a load lifting mechanism connected to the beam, the mechanism having means for engaging a load to be lifted;

a first vertical guide extending between the lower side beam and the upper side beam of the first side support frame, the vertical being spaced from the two vertical legs of the first side support frame;

an operator cab being vertically movable between a lowermost and an uppermost position the operator cab being guided along one of its sides by the first vertical guide; and, a means for vertically moving the operator cab, the operator cab being movable by said means independently of the loading lifting mechanism.

2. The gantry crane of claim 1 wherein the lower side beam of the first side support frame has a downwardly-extending portion to accommodate a lower-most position of the operator cab.

3. The gantry crane of claim 2 wherein the first vertical guide is connected to the lower side beam in the downwardly-extending portion.

4. The gantry crane of claim 1 wherein the means for vertically moving the operator cab includes at least one cable attached at one end thereof to the operator cab and connected at another end of the cable to a means for accumulating the cable, the cable having at least a portion thereof with a path over the operator cab.

5. The gantry crane of claim 1 further comprising a second vertical guide spaced from the first vertical guide and spaced from the vertical legs of the first side support frame, the operator cab positioned between the guides and being vertically moveable along the guides.

6. The gantry crane of claim 5 wherein the upper side beam of the first side support frame has an offset portion and an upper end of the first vertical guide being connected to the upper side beam in the offset portion.

7. The gantry crane of claim 5 wherein the second side support frame has a vertical guide extending between the upper side beam and lower side beam wherein a stabilizing beam is moveable along the first vertical guide of the first side support frame and vertical guide of the second side support frame, the stabilizing beam being operatively connected to the load lifting mechanism.

8. The gantry crane of claim 1 wherein the means for vertically moving the operator cab comprises;

a cable having a length and having a first end fixed to the operator cab and a second end fixed to the first side support frame; and means for urging the cable between its fixed first and second ends in a direction transverse to a portion of its length.

9. The gantry crane of claim 8 wherein the means for urging comprises a hydraulic cylinder with one end mounted on the first side support frame, and an opposed end adapted to contact the cable, the cylinder having an extension path which is transverse to a portion of the length of the cable.

10. The gantry crane of claim 9 wherein the cable passes around a pulley mounted on the, upper side beam of the first side support frame.

11. The gantry crane of claim 10 wherein the hydraulic cylinder urges the cable in a portion of its length lying between the pulley and the cable end fixed to the first side support frame.

12. The gantry crane of claim 9 including a pulley mounted on one end of the hydraulic cylinder, wherein the portion of cable length passes around the pulley.

13. The gantry crane of claim 1 wherein the operator cab has an access door and means for preventing the door from opening when the operator cab is moved vertically from the lower-most position.

14. The gantry crane of claim 13 wherein the means for preventing comprises a shaft rotatably mounted to an outside portion of the operator cab, the shaft having an arm on an end of the shaft which, when the shaft rotates, the arm moves to a position across the access door when the operator cab is vertically moved from the lower-most position preventing the access door from being opened.

15. A gantry crane comprising:

a first side support frame having two vertical legs connected by an upper side beam and a lower side beam, the upper side beam having an offset portion and the lower-side beam having a downwardly-extending portion defining a lower-most position, the side support frame having spaced first and second vertical guides, the vertical guides extending between the offset portion of the upper-side beam and downwardly-extending portion of the lower-side beam;

a second side support frame having two vertical legs connected by an upper-side beam and a lower side beam and a vertical guide extending between the upper-side beam and lower-side beam;

first and second trolley beams spacing the first and second side support frames;

a load lifting mechanism connected to the trolley beams, the mechanism having means for engaging a load to be lifted;

a stabilizing beam connected to the lifting mechanism and moveable along the first vertical guide of the first side support frame and the vertical guide of the second side support frame;

an operator cab vertically moveable along the vertical guides of the first side support frame by a hydraulic lifting mechanism comprising a cable having a length and having a first end fixed to the operator cab and second end-fixed to the upper side beam of the first side support frame, and a hydraulic cylinder with one end mounted on the upper side beam of the first side support frame and an opposed end adapted to contact the cable, the cylinder having an extension path which is transverse to a portion of the length of the cable.

* * * * *

UNITED STATES PATENT AND TRADEMARK OFFICE

CERTIFICATE OF CORRECTION

PATENT NO. : 5,810,183
DATED : September 22, 1998
INVENTOR(S) : Thomas Feider and Norbert Lenius

It is certified that error appears in the above-identified patent and that said Letters Patent is hereby corrected as shown below:

Column 8, line 15, the numeral "106" should read -- 40 -- and the numeral "40" should read -- 106 --

Column 11, line 51, after the word "position" should appear a comma -- , --

Column 11, line 56, the word appearing as "loading" should read -- load --

Column 12, line 33, the words "the, upper" should read -- the upper --

Signed and Sealed this

Twenty-ninth Day of June, 1999

*Attest:*

*Attesting Officer*

Q. TODD DICKINSON

*Acting Commissioner of Patents and Trademarks*